United States Patent [19]

McGarry et al.

[11] 4,253,614

[45] Mar. 3, 1981

[54] FLOTATION OF NON-SULFIDE ZINC MATERIALS

[75] Inventors: Phillip E. McGarry, Palmerton; Zoran Pacic, Bethlehem, both of Pa.

[73] Assignee: The New Jersey Zinc Company, Palmerton, Pa.

[21] Appl. No.: 54,742

[22] Filed: Jul. 5, 1979

[51] Int. Cl.[3] ..... B03B 1/04; B03D 1/02

[52] U.S. Cl. ..... 241/24; 209/5; 209/166

[58] Field of Search ..... 209/166, 167, 5; 241/20, 24

[56] References Cited

U.S. PATENT DOCUMENTS

| | | | |
|---|---|---|---|
| 2,251,217 | 7/1941 | Woodhouse | 209/166 |
| 3,235,077 | 2/1966 | McGarry | 209/166 |
| 3,292,780 | 12/1966 | Frommer | 209/166 X |
| 3,469,652 | 9/1969 | Freyberger | 209/166 |
| 3,589,623 | 6/1971 | Weston | 209/166 R |

FOREIGN PATENT DOCUMENTS

| | | | |
|---|---|---|---|
| 203943 | 11/1956 | Australia | 209/166 |
| 575453 | 5/1959 | Canada | 209/166 |
| 897389 | 10/1953 | Fed. Rep. of Germany | 209/166 |
| 1011183 | 4/1952 | France | 209/166 |
| 194260 | 5/1924 | United Kingdom | 209/166 |
| 464335 | 6/1971 | U.S.S.R. | 209/166 |

*Primary Examiner*—Robert Halper

*Attorney, Agent, or Firm*—Gregory J. Battersby

[57] ABSTRACT

A method is provided for recovering zinc from non-sulfide containing zinc ore comprising the steps of grinding the ore to a pre-determined level; selectively flocculating the ground ore using a dispersing agent and a flocculating agent and froth flotating the flocs using an ester of a mercaptocarboxylic acid as a collector in the presence of a soluble sulfide.

9 Claims, No Drawings

FLOTATION OF NON-SULFIDE ZINC MATERIALS

BACKGROUND OF THE INVENTION

The present invention relates generally to the separation of zinc from zinc ore and, more particularly, to the flotation of zinc minerals from non-sulfide zinc ores using an ester of a mercaptocarboxylic acid as a collector.

Zinc is naturally found in association with lead in mixed lead-zinc ores which may or may not be sulphidic. Non-sulfide zinc ores include hemimorphite (basic zinc silicate) and smithsonite (zinc carbonate); hydrozincite (basic zinc carbonate); loseyite (basic zinc silicate) and willemite (zinc silicate). Various procedures have been employed to separate the zinc from the ore, flotation being one of the most commonly used. See, for example, U.S. Pat. Nos. 4,118,312 and 4,139,455 which issued to G. Barbery et al. on Oct. 3, 1978 and to R. M. Griffith et al. on Feb. 13, 1979, respectively. In such flotation procedures, the ore is first ground to a size sufficient to liberate the zinc mineral which is then introduced with a collector into a buoyant, air-bubble containing medium. Bubbles are produced in a flotation machine by mechanical agitation or by the direct introduction of air under pressure. The collector serves to enable the minerals to cling to the air bubbles.

Flotation has been successfully used commercially to separate zinc from mixed sulfide zinc ores; one such process being described, for example, in U.S. Pat. No. 3,235,077 which issued to P. E. McGarry et al. on Feb. 15, 1966.

The separation of zinc from non-sulfide zinc ores by flotation has proven somewhat less commercially practical. One such attempt is described in U.S. Pat. No. 2,482,859 which issued to W. J. McKenna et al. on Sept. 27, 1949 where a soluble compound of an aliphatic amine was used as a collector. The use of primary alkyl amines as collectors are taught in French Pat. Nos. 1,001,166; 1,011,183; 1,036,092 and provisional French Pat. No. 634,508. Other approaches include the use of amyl xanthate as a collector.

A particular problem presented in floating non-sulfide zinc ores is the presence of a slime which must be removed prior to or at an early stage of the processing. These slimes are very fine particulate matter, often silicates. The desliming operation may be accomplished mechanically such as, for example, by the use of a hydrocyclone. The disadvantage of any desliming operation is that it adds an additional step which is not only costly but, invariably may result in the loss of up to 40% of the zinc in the discarded slimes.

The use of flotation techniques for non-sulfide zinc ores requires the addition of a substantial amount of soluble sulfide. See, for example, McKenna U.S. Pat. No. 2,482,859, which employs between 6 and 12 pounds of sodium sulfide per ton of ore.

It has been found that by subjecting the ground ore to a selective flocculation step prior to flotation and utilizing an ester of a mercaptocarboxylic acid as a collector during flotation, concentration of the zinc may be accomplished without need for a separate desliming step and also require substantially smaller amounts of soluble sulfide than heretofore required, i.e. less than about two pounds per ton of ore. Since the loss of zinc in desliming is eliminated, zinc recovery is substantially improved.

Against the foregoing background, it is a primary objective of the present invention to provide a method for recovering zinc from non-sulfide zinc ores.

It is a further objective of the present invention to provide such a flotation method for non-sulfide zinc ores in which a desliming operation is not required.

It is another objective of the present invention to provide such a flotation method for non-sulfide zinc ores wherein a selective flocculation step is employed prior to flotation.

It is still another objective of the present invention to provide such a flotation method for non-sulfide zinc ores wherein a selective flocculation step is employed prior to flotation and an ester of a mercaptocarboxylic acid is utilized as a collector during flotation.

It is yet another objective of the present invention to provide a flotation method requiring the addition of substantially smaller amounts of soluble sulfides than heretofore required.

SUMMARY OF THE PRESENT INVENTION

To the accomplishments of the foregoing objects and advantages, the present invention, in brief summary, comprises a method for recovering zinc from non-sulfide zinc ores. In this process, the ore is initially ground to a pre-determined size and selectively flocculated by the addition of a dispersing agent selected from the group consisting of soluble silicates and condensed phosphates and a flocculating agent selected from the group consisting of caustic starch and caustic tapioca. Sufficient time with gentle agitation must be allowed for flocculation. The flocculated pulp is then froth floated utilizing reagents selected from the group consisting of collectors, collector extenders, frothing agents and soluble sulfides. A preferred collector is an ester of a mercaptocarboxylic acid, particularly 4-methyl-2-amyl 3-mercaptopropionate (4M2AMP) also known as 4-methyl-2 pentyl 3-mercapto, etc., in an amount between about 0.1 and about 2.0 pounds per ton of ore.

DESCRIPTION OF THE PREFERRED EMBODIMENTS

As previously stated, the present invention contemplates a method for the flotation of zinc from non-sulfide zinc ores by the selective flocculation of the ore prior to flotation and then by the use of a specific amount of an ester of a mercaptocarboxylic acid as a collector. It has been found that by performing this selective flocculation operation, the desliming operation heretofore necessary in the flotation of such ores, with its resultant loss of zinc, is not required and, further, that flotation may be effected with substantially smaller amounts of a soluble sulfide than heretofore required.

In the flotation procedure of the present invention, the non-sulfide zinc ore is initially crushed in a number of separate stages, preferably three. The non-sulfide zinc minerals may be hemimorphite, smithsonite, hydrozincite or loseyite. While crushing may be accomplished either wet or dry, crushing in a dry state is preferred.

Water, preferably in an amount sufficient to achieve between a 0.2-1 to 1—1 ratio by weight of water to ore, is added to the crushed ore to form an aqueous pulp which is then ground in at least two separate stages—the first being a coarse grinding operation performed in a conventional rod mill; and the second being performed in a conventional ball mill. It is, of course, understood that the extent of the grinding will vary according to the particular ore since, with certain ores, a considerably finer grind may be preferred to liberate the minerals. After grinding, the non-sulfide zinc ore is wet classified in a conventional classifier. Ore which is ground to the desired size is further processed while coarser ground ore is returned to the ball mill for further grinding.

The classified ground zinc ore is introduced into a series of tanks for selective flocculation wherein certain reagents are added.

The ground and classified zinc ore is then introduced into a conditioning tank wherein a dispersing agent selected from the group consisting of soluble silicates and condensed phosphates is added with rapid agitation for a period of between about 5 and about 10 minutes. In a second conditioning tank receiving the overflow from the first, a flocculating agent selected from the group consisting of caustic starch and caustic tapioca is added with rapid agitation for about 1 minute. Overflow is to a third tank, where agitation is very gentle to permit flocculation to proceed.

The dispersing agent, selected from the group consisting of soluble silicates and condensed phosphates, is added to the ground ore in an amount between about 0.1 and 10.0 pounds per ton of ore and, preferably, in an amount between about 0.3 and about 0.5 pounds per ton of ore. Preferred dispersing agents include sodium silicate, sodium pyrophosphate, potassium pyrophosphate and ammonium pyrophosphate. Additionally, other conventional organic compounds which can effect the dispersion of clays may be utilized.

The flocculating agent employed, either caustic starch or caustic tapioca, is then added to the ore in the second conditioning tank in an amount between about 0.1 and 10 pounds per ton of ore and preferably between about 0.3 and about 0.5 pounds. Caustic starch is a mixture of approximately 4 grams of starch, 1 liter of water and 1 gram of sodium hydroxide. Similarly, caustic tapioca is mixed in the same manner as caustic starch with tapioca replacing the starch. These mixtures are generally heated to a temperature between about 70° and about 90° C. for about ½ hour.

Agitation in the third tank is at a much slower speed and generally for between about 2 to about 20 minutes to allow an increase in the size of the floccules, i.e., to permit the floccules to increase in size to between about 100% and about 1000% of their original size.

Selective flocculation permits subsequent flotation of the zinc without desliming. The advantage offered by this selective flocculation operation instead of a mechanical desliming operation is that the zinc losses in desliming, often between about 20% and about 40%, is eliminated since there are no discarded slimes.

The flocculated pulp is then introduced into a first rough flotation tank wherein flotation reagents, including a soluble sulfide, a collector, a collector extender and a frothing agent are added.

Virtually any conventional frothing agent may be utilized including alcohols, polypropylene glycol and pine oils. Preferred alcohols include alcohols having between 6 and 8 carbon atoms. Frothing agents may be added in an amount up to about 10 pounds per ton of ore and preferably in an amount between about 0.3 and 0.5 pounds per ton of ore.

A soluble sulfide must also be added to the flocculated pulp. The soluble sulfide is added in an amount sufficient to presumably become totally absorbed on the surface of the zinc but not sufficient to have free sulfide ions in solution. The amount of soluble sulfide added is generally in an amount between about 0.2 and 2.0 pounds per ton of ore. A preferred amount of soluble sulfide is an amount between about 1.0 and about 2.0 pounds per ton of ore. While sodium sulfide is a preferred soluble sulfide, other soluble sulfides which may be used include, for example, calcium sulfide, barium sulfide and ammonium polysulfide.

The collector used is an ester of mercaptocarboxylic acid having the formula $$R-O-\overset{\overset{\displaystyle O}{\|}}{C}-[C_nX]-Y$$

wherein R is an alkyl or aryl-substituted alkyl radical, n is an integer such that the ester has sufficient water solubility to function as a collector when used in an amount up to about 1.0 pounds per ton of ore, and X is a total of 2 times n radicals of which at least one is an SH (hydrosulfide) radical and at least one is a hydrogen, alkyl, aryl, aryl-substituted alkyl or halogen radical. Preferred collectors include isopropyl, isobutyl, n-amyl, benzyl and iso-octyl thioglycolates (α-mercaptoacetates), isopropyl B-mercaptopropionate and isobutyl thiolactate. A particularly preferred collector is 4-methyl 2-amyl 3-mercaptopropionate which is highly water soluble, is not particularly volatile and does not produce the odor of short chain mercaptans.

The mercaptocarboxylic acid ester is used as a collector in an amount between about 0.1 and about 2.0 pounds per ton of ore and preferably in an amount between about 1.0 and about 2.0 pounds per ton of ore. A most preferred amount of mercaptocarboxylic acid ester is an amount between about 1.5 and 2.0 pounds per ton of ore.

It is to be understood that the flotation reagents, i.e., collectors and soluble sulfides, may be added in a number of small incremental steps throughout the flotation process.

Conventional extenders including, for example, tar bases and No. 2 fuel oil, may be added with the mercaptocarboxylic acid ester in an amount up to about 1.0 pounds per ton of ore and preferably between about 0.2 and about 0.6 pounds per ton of ore.

Conventional frothing agents including, for example, 6 to 8 carbon alcohols, polypropylene glycol and pine oil, may be used in amounts up to about 1.0 pounds per ton of ore and preferably in an amount between about 0.1 and about 1.0 pounds per ton of ore.

The flocculated pulp with all of the flotation reagents is then processed through successive stages of an otherwise conventional flotation operation in order to concentrate the zinc. Conventional flotation equipment which may be used include the "Sub A" flotation equipment marketed by Denver Equipment Company of Denver, Colo. In such equipment, the flocculated pulp is agitated by blowing compressed air through it causing a stream of air bubbles which rise to the surface. The flotation reagents, particularly the collector, render the surface of the zinc material particles water repellant, thereby causing them to adhere to the bubbles and thus be carried to the surface where they pass over an overflow weir to successive flotation stages during which the process is repeated and the concentration of zinc mineral is successively increased.

In a preferred embodiment, the zinc containing flocculated pulp is processed through a series of flotation stages including a rough flotation step, a scavenger flotation step and then through a series, preferably three or more, of cleaning flotation steps prior to final concentration.

In another embodiment, a second selective flocculation step may be performed between stages of flotation, preferably between rougher flotation and cleaning flotation.

The following examples serve to further illustrate the method of the present invention and are not construed as limiting the scope of the present invention.

EXAMPLE 1

A non-sulfide zinc ore was processed using the method of the present invention. The ore had the following chemical composition:

| | |
|---|---|
| Zn | 24.2% |
| MgO | 0.6% |
| $Fe_2O_3$ | 6.7% |
| $Al_2O_3$ | 4.8% |
| $CO_2$ | 7.5% |
| Cl ppm | <4 |

The ore was crushed and ground to a particle size of 100 mesh and introduced into a conditioning tank to which was added:

| | |
|---|---|
| $Na_2CO_3$ | 0.135 lb/ton of ore |
| Na pyrophosphate | 1.725 lb/ton |

and agitated actively for 15 minutes. The pulp was then transferred to a settling tank to which was added 0.9 lb/ton of caustic tapioca and it was permitted to settle for 10 minutes.

The flocculated pulp was then transferred to rough flotation and the following reagents were added:

| | |
|---|---|
| A-65 | 0.015 lb/ton ore |
| $Na_2S$ | 0.63 lb/ton |
| 4M2AMP | 0.87 lb/ton |
| 2:1 mixture tar base and No. 2 fuel oil | 0.17 lb/ton |

Rough flotation and scavenger flotation were performed for 6 minutes.

Prior to cleaning, a secondary selective flocculation was performed wherein 0.078 lb/ton of $Na_2CO_3$ and 0.90 lb/ton of sodium silicate were added to the flocculated rougher concentrate and it was agitated for 15 minutes. 0.40 lb/ton of caustic tapioca was added and it was permitted to settle for 10 minutes.

The flocculated rougher concentrate was cleaned four times for periods of 5, 4, 3 and 2 minutes each. During the cleaning, the following reagents were added:

| | |
|---|---|
| $Na_2S$ | 0.28 lb/ton |
| 4M2AMP | 0.56 lb/ton |

The metallurgical material balance was as follows:

| | Calc Feed | Clnr Conc | 4th Cl Tails | 3rd Cl Tail | 2nd Cl Tail | 1st Cl Tail | Rough Conc | Final Tails |
|---|---|---|---|---|---|---|---|---|
| Wgt % | 100.00 | 29.63 | 13.91 | 6.53 | 9.28 | 7.23 | 66.58 | 33.42 |
| Assay % | | | | | | | | |
| Zn | 24.3 | 42.0 | 34.2 | 24.0 | 22.0 | 16.3 | 33.0 | 7.05 |
| MgO | 0.47 | 0.26 | 0.40 | 0.52 | 0.53 | 0.72 | 0.40 | 0.60 |
| Dist. % | | | | | | | | |
| Zn | 100.0 | 51.1 | 19.5 | 6.4 | 8.4 | 4.9 | 90.3 | 9.7 |
| MgO | 100.0 | 16.5 | 11.9 | 7.4 | 10.5 | 11.1 | 57.4 | 42.6 |

EXAMPLE 2

A second non-sulfide zinc ore having the following chemical composition was processed using the method of the present invention:

| | |
|---|---|
| Zn | 18.6% |
| MgO | 12.6% |
| $Fe_2O_3$ | 8.0% |
| $Al_2O_3$ | 1.9% |
| $CO_2$ | NA |
| Cl ppm | <5 |

The ore ground to a particle size of 70%-200 mesh, was introduced into a conditioning tank to which was added:

| | |
|---|---|
| $Na_2CO_3$ | 0.135 lb/ton of ore |
| Na pyrophosphate | 1.725 lb/ton |

and agitated actively for 15 minutes. The pulp was then transferred to a "settling" tank to which was added 0.9 lb/ton of caustic tapioca, and was agitated very slowly for 10 minutes.

The flocculated pulp was then transferred to rough flotation and the following reagents were added:

| | |
|---|---|
| A-65 | 0.015 lb/ton ore |
| $Na_2S$ | 0.72 lb/ton |
| 4M2AMP | 0.68 lb/ton |
| 2:1 mixture tar base and No. 2 fuel oil | 0.12 lb/ton |

After rougher flotation and scavenger flotation for 6 minutes, the froth was cleaned twice for periods of 3 and 2 minutes each, during which time the following reagents were added:

| | |
|---|---|
| $Na_2S$ | 0.45 lb/ton |
| 4M2AMP | 0.58 lb/ton |

The following metallurgical material balance was made:

| | Calc Feed | Cleaner Conc | 2nd Cl Tail | 1st Cl Tail | Rough Conc | Scav Conc | Final Tails |
|---|---|---|---|---|---|---|---|
| Wgt % | 100.0 | 20.16 | 4.86 | 3.86 | 28.88 | 29.45 | 41.67 |
| Assay % | | | | | | | |
| Zn | 18.6 | 44.0 | 35.8 | 21.6 | 39.6 | 15.08 | 6.50 |
| MgO | 8.50 | 1.11 | 3.10 | 6.80 | 2.21 | 9.17 | 12.40 |
| $Fe_2O_3$ | 7.24 | 3.60 | 6.52 | 13.20 | 5.37 | 9.33 | 7.05 |

-continued

| | Calc Feed | Cleaner Conc | 2nd Cl Tail | 1st Cl Tail | Rough Conc | Scav Conc | Final Tails |
|---|---|---|---|---|---|---|---|
| $Al_2O_3$ | 2.01 | 0.70 | 1.50 | 3.60 | 1.22 | 2.37 | 2.30 |
| Dist. % | | | | | | | |
| Zn | 100.0 | 47.7 | 9.3 | 4.5 | 61.5 | 23.9 | 14.6 |
| MgO | 100.0 | 2.6 | 1.8 | 3.1 | 7.5 | 31.7 | 60.8 |
| $Fe_2O_3$ | 100.0 | 10.0 | 4.4 | 7.0 | 21.4 | 38.0 | 40.6 |
| $Al_2O_3$ | 100.0 | 7.0 | 3.7 | 6.9 | 17.6 | 34.7 | 47.7 |

EXAMPLE 3

In order to fully illustrate the method of the present invention, non-sulfide zinc ore which assayed as follows was processed:

| | Assay % |
|---|---|
| Zn | 16.7 |
| MgO | 0.74 |
| $Fe_2O_3$ | 6.6 |
| $Al_2O_3$ | 5.4 |
| $CO_2$ | 2.5 |
| Cl ppm | <4 |

The zinc ore was crushed and ground in a ball mill and classified to a maximum size of 70 mesh. The pulp was then introduced into a conditioning tank to which $Na_2CO_3$ was added in an amount of 0.135 lb/ton of ore, $Na_2SiO_3$ in an amount of 1.5 lb/ton and the mixture was agitated for 15 minutes. After rapid agitation, the pulp was then transferred into a tank for selective flocculation wherein 0.9 pounds per ton of caustic tapioca were added and was gently agitated for 10 minutes.

The flocculated pulp was then fed to rough flotation wherein the following flotation agents were added:

| | |
|---|---|
| A-65 polypropylene glycol | 0.15 lb/ton ore |
| $Na_2S$ | 0.88 lb/ton |
| 4M2AMP | 0.83 lb/ton |
| 2:1 mixture of tar base and No. 2 fuel oil | 0.22 lb/ton |

After rough flotation for 8 minutes, the pulp was then transferred to scavenger flotation for an additional 2 minutes during which time the following were added:

| | |
|---|---|
| $Na_2S$ | 0.1 lb/ton |
| 4M2AMP | 0.12 lb/ton |
| 2:1 mixture | 0.05 lb/ton |

The froth was then cleaned in three stages of 4 minutes, 3 minutes and 2 minutes during which time the following were added:

| | |
|---|---|
| $Na_2S$ | 0.8 lb/ton |
| 4M2AMP | 0.65 lb/ton |

The metallurgical material balance was as follows:

| | Calc Feed | Cleaner Conc | 3rd Cl Tail | 2nd Cl Tail | 1st Cl Tail | Rough Conc | Scav Conc | Final Tails |
|---|---|---|---|---|---|---|---|---|
| Wgt % | 100.0 | 7.11 | 16.45 | 14.88 | 6.34 | 44.78 | 23.69 | 31.53 |
| Assay % | | | | | | | | |
| Zn | 17.7 | 45.8 | 32.4 | 23.6 | 11.6 | 28.7 | 14.7 | 4.37 |
| MgO | 0.71 | 0.16 | 0.35 | 0.57 | 0.80 | 0.46 | 0.78 | 1.02 |
| $Fe_2O_3$ | 8.03 | 1.12 | 2.93 | 7.95 | 12.20 | 5.62 | 10.49 | 9.60 |
| $Al_2O_3$ | 5.63 | 1.00 | 2.00 | 6.10 | 11.50 | 4.55 | 7.88 | 5.48 |
| Dist. % | | | | | | | | |
| Zn | 100.0 | 18.4 | 30.1 | 19.8 | 4.2 | 72.5 | 19.7 | 7.8 |
| MgO | 100.0 | 1.6 | 8.1 | 11.9 | 7.2 | 28.8 | 26.0 | 45.2 |
| $Fe_2O_3$ | 100.0 | 1.0 | 6.0 | 14.7 | 9.7 | 31.4 | 30.9 | 37.7 |
| $Al_2O_3$ | 100.0 | 1.3 | 5.9 | 16.1 | 12.9 | 36.2 | 33.1 | 30.7 |

Conventional "Locked Tests" were now run yielding the following results:

METALLURGICAL CALCULATIONS

| | | Cleaner Concentrate | | | | | |
|---|---|---|---|---|---|---|---|
| | Calc. Feed | Run No. 1 | Run No. 2 | Run No. 3 | Run No. 4 | Run No. 5 | Avs. |
| Weight % | 100.00 | 4.75 | 4.85 | 6.93 | 8.66 | 6.92 | 6.42 |
| Assay % | | | | | | | |
| Zn | 16.63 | 44.80 | 44.00 | 42.60 | 40.70 | 43.90 | 42.90 |
| MgO | 1.16 | 0.73 | 0.60 | 0.68 | 0.50 | 0.52 | 0.59 |
| $Fe_2O_3$ | 7.63 | 3.20 | 3.40 | 4.47 | 4.22 | 3.40 | 3.82 |
| $Al_2O_3$ | 4.46 | 3.70 | 1.60 | 2.00 | 1.90 | 1.40 | 2.03 |
| Distribution % | | | | | | | |
| Zn | 100.00 | 90.91 | 87.79 | 90.72 | 92.69 | 89.95 | 90.60 |
| MgO | 100.00 | 17.02 | 19.03 | 18.99 | 29.89 | 13.21 | 18.53 |
| $Fe_2O_3$ | 100.00 | 13.78 | 17.14 | 20.49 | 32.25 | 14.07 | 19.23 |
| $Al_2O_3$ | 100.00 | 22.20 | 17.40 | 18.66 | 33.45 | 9.98 | 18.98 |

| | | Final Tails | | | | |
|---|---|---|---|---|---|---|
| | Run No. 1 | Run No. 2 | Run No. 3 | Run No. 4 | Run No. 5 | Avs. |
| Weight % | 11.20 | 10.23 | 11.19 | 9.92 | 12.85 | 11.08 |
| Assay % | | | | | | |
| Zn | 1.90 | 2.90 | 2.70 | 2.80 | 2.64 | 2.58 |
| MgO | 1.51 | 1.21 | 1.80 | 1.06 | 1.84 | 1.51 |
| $Fe_2O_3$ | 8.49 | 7.79 | 10.74 | 7.74 | 11.18 | 9.31 |
| $Al_2O_3$ | 5.50 | 3.60 | 5.40 | 3.30 | 6.80 | 5.04 |
| Distribution % | | | | | | |
| Zn | 9.09 | 12.21 | 9.28 | 7.31 | 10.05 | 9.40 |
| MgO | 82.98 | 80.97 | 81.01 | 70.11 | 86.79 | 81.47 |
| $Fe_2O_3$ | 86.22 | 82.86 | 79.51 | 67.75 | 85.93 | 80.77 |
| $Al_2O_3$ | 77.80 | 82.60 | 81.34 | 66.55 | 90.02 | 81.02 |

The significance of these locked tests is that they indicate the advantages offered by the process of the present invention, especially with respect to the high zinc concentrate grades and recoveries and high elimination of impurities when the various middling products of the previous tests are recycled in simulation of plant practice.

EXAMPLE 4

A non-sulfide zinc ore of the following chemical composition was processed using the method of the present invention:

| | |
|---|---|
| Zn | 20.7% |
| MgO | 1.2% |
| $Fe_2O_3$ | 9.3% |

-continued

| | |
|---|---|
| $Al_2O_3$ | 4.7% |
| $CO_2$ | 8.8% |
| Cl ppm | <4 |

The ore was crushed and ground to a particle size of 150 mesh and introduced into a conditioning tank to which was added:

| | |
|---|---|
| $Na_2CO_3$ | 0.135 lb/ton of ore |
| $Na_4P_2O_7 \cdot 10H_2O$ | 1.5 lb/ton |

and agitated actively for 15 minutes. The pulp was transferred to a settling tank to which was added 0.9 lb/ton of caustic tapioca and was permitted to settle for 10 minutes.

The flocculated pulp was then transferred to rough flotation with the following reagents added:

| | |
|---|---|
| polypropylene glycol | 0.15 lb/ton ore |
| $Na_2S$ | 0.92 lb/ton |
| 4M2AMP | 0.89 lb/ton |
| 2:1 mixture tar base and No. 2 fuel oil | 0.25 lb/ton |

After rough flotation for 8 minutes, the pulp was transferred for scavenger flotation for an additional two minutes, during which time the following were added:

| | |
|---|---|
| $Na_2S$ | 1.2 lb/ton |
| 4M2AMP | 0.15 lb/ton |
| 2:1 mixture | 0.075 lb/ton |

Prior to cleaner flotation, a secondary selective flocculation was performed wherein 0.135 lb/ton of $Na_2CO_3$ and 0.93 lb/ton of $Na_4P_2O_7 \cdot 10H_2O$ were added to the rougher concentrate and agitated for 15 minutes followed by the addition of 0.46 lb/ton of caustic tapioca. This flocculated concentrate was permitted to settle for 10 minutes.

The flocculated concentrate was then processed through cleaning flotation four separate times for periods of 5, 4, 3 and 2 minutes, each. During these cleaning stages, the following reagents were added:

| | |
|---|---|
| $Na_2S$ | 0.95 lb/ton |
| 4M2AMP | 0.98 lb/ton |

The following metallurgical material balance was made:

| | Calc Feed | Clnr Conc | 4th Cl Tails | 3rd Cl Tail | 2nd Cl Tail | 1st Cl Tail | Rough Conc | Scav Conc | Final Tails |
|---|---|---|---|---|---|---|---|---|---|
| % | 100.0 | 22.3 | 9.1 | 2.7 | 7.6 | 10.8 | 52.5 | 24.7 | 22.8 |
| Assay % | | | | | | | | | |
| Zn | 24.0 | 46.6 | 44.6 | 19.3 | 21.1 | 15.9 | 34.8 | 17.81 | 5.70 |
| Dist. % | | | | | | | | | |
| Zn | 100.0 | 43.3 | 16.9 | 2.2 | 6.7 | 7.1 | 76.3 | 18.3 | 5.4 |

A conventional "locked test" was then run with the following results:

METALLURGICAL CALCULATIONS

| | | Cleaner Concentrate | | | | | |
|---|---|---|---|---|---|---|---|
| | Calc. Feed | Run No. 1 | Run No. 2 | Run No. 3 | Run No. 4 | Run No. 5 | Avs. |
| Weight % | 100.00 | 5.96 | 6.41 | 8.03 | 7.20 | 7.63 | 7.05 |
| Assay % | | | | | | | |
| Zn | 23.71 | 46.2 | 43.7 | 40.5 | 45.3 | 45.6 | 44.13 |
| MgO | 0.80 | 0.263 | 0.288 | 0.350 | 0.201 | 0.216 | 0.265 |
| $Fe_2O_3$ | 8.46 | 3.8 | 5.0 | 6.3 | 4.5 | 4.5 | 4.88 |
| $Al_2O_3$ | 4.01 | 1.8 | 2.6 | 3.2 | 1.9 | 2.1 | 2.35 |
| Cl ppm | 8 | 13 | 4 | 7 | 4 | 7 | 6.86 |
| Distribution % | | | | | | | |
| Zn | 100.00 | 88.38 | 81.80 | 84.93 | 90.26 | 91.50 | 87.42 |
| MgO | 100.00 | 16.19 | 14.83 | 20.96 | 15.60 | 16.61 | 17.03 |
| $Fe_2O_3$ | 100.00 | 26.24 | 25.82 | 31.46 | 31.53 | 32.46 | 29.67 |
| $Al_2O_3$ | 100.00 | 24.15 | 31.48 | 34.32 | 25.73 | 30.74 | 29.83 |
| Cl | 100.00 | 53.02 | 28.26 | 45.31 | 44.51 | 58.69 | 46.73 |

| | Final Tails | | | | | |
|---|---|---|---|---|---|---|
| | Run No. 1 | Run No. 2 | Run No. 3 | Run No. 4 | Run No. 5 | Avs. |
| Weight % | 6.24 | 9.30 | 8.48 | 7.18 | 7.52 | 7.74 |
| Assay % | | | | | | |
| Zn | 5.8 | 6.7 | 6.8 | 4.9 | 4.3 | 5.78 |
| MgO | 1.30 | 1.14 | 1.25 | 1.09 | 1.10 | 1.17 |
| $Fe_2O_3$ | 10.2 | 9.9 | 13.0 | 9.8 | 9.5 | 10.53 |
| $Al_2O_3$ | 5.4 | 3.9 | 5.8 | 5.5 | 4.8 | 5.03 |
| Cl ppm | 11 | 7 | 8 | 5 | 5 | 7.11 |
| Distribution % | | | | | | |
| Zn | 11.02 | 18.20 | 15.07 | 9.74 | 8.50 | 12.58 |
| MgO | 83.81 | 85.17 | 79.04 | 84.4 | 83.39 | 82.97 |
| $Fe_2O_3$ | 73.76 | 74.12 | 68.54 | 68.47 | 67.54 | 70.33 |

-continued

| METALLURGICAL CALCULATIONS | | | | | | |
|---|---|---|---|---|---|---|
| $Al_2O_3$ | 75.85 | 68.52 | 65.68 | 74.27 | 69.26 | 70.17 |
| Cl | 46.98 | 71.74 | 54.69 | 55.49 | 41.31 | 53.27 |

These locked tests again indicate a particularly effective process as evidenced by the high zinc contents in the cleaner concentrate.

EXAMPLE 5

In order to demonstrate the effects of practicing the method of the present invention using a mercaptocarboxylic acid ester as a collector but eliminating a selective flocculation step, oxidized zinc ore having 17.6% by weight of zinc was wet ground at 65% solids to about 90% minus 200 mesh, and conditioned for 15 minutes with 0.55 lbs. of NaOH, 0.25 lbs. of sodium silicate, 0.05 lbs. of sodium cyanide and 3.0 lbs. of sodium sulfide per ton of feed.

The pulp was then deslimed by separation into size fractions by sedimentation and decantation. The settling distance was 15 cm and each size fraction was decanted ten times yielding size fractions of $+40\mu$; $-40+20\mu$; $-20+10\mu$ and $-10\mu$.

Each of the size fractions except the $-10\mu$ slimes was charged to a Fagergron laboratory flotation machine and flotated to produce a rougher concentrate and rougher tailings using the following reagents:

| | | Pounds Per Ton of Whole Feed | | | |
|---|---|---|---|---|---|
| Size Fraction | Wgt. (gm) | 4M2AMP | $Na_2S$ | 2:1 Mixture Tar Base and No. 2 Fuel Oil | polypropylene glycol |
| $+40\mu$ | 503.0 | 0.24 | 0.40 | 0.06 | 0.01 |
| $-40\mu+20\mu$ | 122.7 | 0.13 | 0* | 0.03 | 0.01 |
| $-20\mu+10\mu$ | 55.8 | 0.11 | 0.20 | 0.03 | 0.01 |
| $-10\mu$ | 283.9 | — | — | — | — |
| Totals: | 965,4 | | | | |

*$Na_2S$ was not needed due to the large amount used prior to desliming.

These reagents were added in small, equal increments except for the polypropylene glycol which was added only once initially.

The metallurgical results were as follows:

| | Rougher Concentrate | | | |
|---|---|---|---|---|
| | $+40\mu$ | $-40\mu$ $+20\mu$ | $-20\mu$ $+10\mu$ | Total $+10\mu$ |
| Weight % | 24.3 | 10.0 | 4.1 | 38.4 |
| Assay % Zn | 31.1 | 21.7 | 25.3 | 28.0 |
| Dist. % Zn | 42.8 | 12.3 | 6.0 | 61.1 |

| | Rougher Tailings | | | | | |
|---|---|---|---|---|---|---|
| | $+40\mu$ | $-40\mu$ $+20\mu$ | $-20\mu$ $+10\mu$ | Total $+10\mu$ | $-10\mu$ Slimes | Calc Feed |
| Weight % | 27.9 | 2.7 | 1.6 | 32.2 | 29.4 | 100.0 |
| Assay % Zn | 5.0 | 6.1 | 10.6 | 5.4 | 17.4 | 17.6 |
| Dist. % Zn | 7.9 | 0.9 | 1.0 | 9.8 | 29.1 | 100.0 |

The above results demonstrate the efficacy of the use of the mercaptocarboxylic acid esters as collectors although the final zinc recovery was reduced due to the inability to float in the presence of non-sulfide zinc mineral slimes.

Although the foregoing Examples illustrate certain features of the novel method of the present invention, it will, of course, be appreciated that the teachings of this application encompass broader and different combinations other than those recited in these Examples. Accordingly, the present invention should only be limited by the time scope of the appended claims.

What is claimed is:

1. A method for recovering zinc from non-sulfide containing zinc ore, said method comprising the steps of:

grinding said zinc ore to between about 70 and about 200 mesh;

selectively flocculating said ore by admixing said ore with a dispersing agent selected from the group consisting of soluble silicates and condensed phosphates and a flocculating agent selected from the group consisting of caustic tapioca and caustic starch under rapid agitation and permitting the resultant floccules to settle for a pre-determined period of time; and froth floating the floccules in stages with the addition of a collector consisting of between about 0.1 and about 2.0 pounds per ton of ore of an ester of a mercaptocarboxylic acid.

2. The method of claim 1 wherein said collector is an effectively water soluble ester of a mercaptocarboxylic acid having the formula $$R-O-\overset{\overset{\displaystyle O}{\|}}{C}-[C_nX]-Y$$

in which:

R is a radical of the group consisting of alkyl and aryl-substituted alkyl radicals;

n is an integer such that the ester has sufficient water solubility to function as the collector when used in an amount up to about 1.0 pounds per ton of ore;

X is a total of 2 n radicals of which at least one is an SH radical and at least one is a radical of the group consisting of hydrogen, alkyl, aryl, aryl-substituted alkyl and halogen radicals; and Y is a radical of the group consisting of hydrogen, alkyl, aryl, aryl-substituted alkyl and halogen radicals, the molecular weight of said ester being not substantially greater than about 200.

3. The method of claim 1 wherein said dispersing agent is present in an amount between about 0.1 and about 10 pounds per ton of ore.

4. The method of claim 1 wherein said flocculating agent is present in an amount between about 0.1 and 10.0 pounds per ton of ore.

5. The method of claim 1 wherein said floccules are allowed to settle for up to about 20 minutes.

6. The method of claim 1 wherein said collector is 4-methyl 2-amyl 3-mercaptopropionate in an amount between about 1.0 and about 2.0 pounds per ton of ore.

7. The method of claim 1 wherein a soluble sulfide is admixed with said ore and collector during flotation in an amount between about 0.1 and about 2.0 pounds per ton of ore.

8. A method for recovering zinc from a non-sulfide zinc ore, said method comprising the steps of:

grinding said zinc ore to between about 70 and about 200 mesh;

selectively flocculating said ore by admixing said ore under rapid agitation with:

a dispersing agent selected from the group consisting of soluble silicates and condensed phosphates in an amount between about 0.3 and about 0.5 pounds per ton of ore; and a flocculating agent selected from the group consisting of caustic starch and caustic tapioca in an amount between about 0.3 and about 0.5 pounds per ton of ore;

permitting the resultant floccules to settle for a period of up to about 20 minutes;

admixing floccules with flotation reagents selected from the group consisting of:

between about 1.5 and about 2.0 of a mercaptocarboxylic acid ester;

between about 0.1 and 1.0 pounds per ton of ore of a soluble sulfide;

up to about 1.0 pounds per ton of ore of a collector extender; and up to about 1.0 pounds per ton of ore of a frothing agent; and froth floating the floccules and flotation reagents in successive stages.

9. The method of claim 9 wherein a second selective flocculation step is performed between stages of the flotation.

* * * * *